US005758710A

United States Patent [19]

Landua et al.

[11] Patent Number: 5,758,710

[45] Date of Patent: Jun. 2, 1998

[54] APPARATUS FOR INSERTING A PART INTO A FOUNDRY CORE TO BE COMPLETED TO A CORE ASSEMBLY

[75] Inventors: Werner Landua, Mannheim; Werner Pichler, Brühl, both of Germany

[73] Assignee: Adolf Hottinger Maschinenbau GmbH, Mannheim, Germany

[21] Appl. No.: 793,951

[22] PCT Filed: Sep. 7, 1995

[86] PCT No.: PCT/DE95/01217

§ 371 Date: Mar. 12, 1997

§ 102(e) Date: Mar. 12, 1997

[87] PCT Pub. No.: WO96/08327

PCT Pub. Date: Mar. 21, 1996

[30] Foreign Application Priority Data

Sep. 12, 1994 [DE] Germany ..... 44 32 323.9
Sep. 24, 1994 [DE] Germany ..... 44 34 193.8

[51] Int. Cl.[6] ..... B22C 13/12

[52] U.S. Cl. ..... 164/200; 164/230

[58] Field of Search ..... 164/28, 168, 186, 164/200, 228, 230, 231, 339

[56] References Cited

FOREIGN PATENT DOCUMENTS

| | | |
|---|---|---|
| 2 304 564 | 8/1974 | Germany . |
| 43 34 857 | 10/1994 | Germany . |
| WO 84/04061 | 10/1984 | WIPO . |

*Primary Examiner*—Kuang Y. Lin
*Attorney, Agent, or Firm*—Bell Seltzer Intellectual Property Law Group of Alston & Bird LLP

[57] ABSTRACT

An apparatus for inserting a part (6) into a foundry core (1) that is to be completed to a core assembly between two core shooting stations (2) is designed and constructed for a fully automatic handling of the part (6) such as to include a magazine (7) for making available the part (6), a manipulator (8) for receiving the part from magazine (7) and delivering the part (6) to the foundry core (1), and a transfer device (9) for moving the manipulator (8) between the magazine (7) and the foundry core (1).

23 Claims, 3 Drawing Sheets

APPARATUS FOR INSERTING A PART INTO A FOUNDRY CORE TO BE COMPLETED TO A CORE ASSEMBLY

BACKGROUND OF THE INVENTION

The invention relates to an apparatus for inserting a part into a foundry core being completed to a core assembly between two core shooting stations.

Basically, the present invention relates to the field of foundry practice. To produce castings, foundry cores or foundry molds are generally made as separate parts, combined and joined together to form a casting mold or core assembly. Thereafter, these core assemblies are filled with molten metal for producing, for example, a metallic workpiece. In mass production, the core assemblies being filled with molten metal pass one after the other through the production line.

Apparatus for producing core assemblies are known already from numerous publications. Only as an example, reference may be made to DE-OS 23 04 564. Furthermore, it is known from practice to make cores that are to be combined to a core assembly, in a production line with several core shooting machines or shooting stations. At each shooting station, a further core is added to the core assembly. To this end, the cores are deposited on a conveyor plate which passes through the individual shooting stations. In most cases, this conveyor plate is used simultaneously as the lower tool of the first shooting station.

In the present case, the apparatus involves basically the insertion of any kind of parts respectively into or onto a foundry core. In this process, the part or parts is or are combined together with the foundry cores to a core assembly. Consequently, in the present case, parts are inserted which consist at least quite predominantly of other materials than shot core sand. In the following, however, the apparatus under discussion will be explained only by way of example and for a better understanding with reference to parts, which are inserted as so-called screen inserts or solidification screens respectively into or onto a foundry core.

In practice, it has shown to be advantageous to provide the core assembly in a lower region with a screen insert or a so-called solidification screen, through which the molten metal can be poured, and is allowed to rise in the core assembly from the bottom and to thus fill the mold. In other words, the molten metal is poured into a channel formed by the individual cores, until it arrives in the lower region, preferably at the lowest core, at the screen insert. After passing through the screen insert, the molten metal is allowed to rise in the core assembly gradually upward and to fill gradually the contours of the core assembly. Normally, the screen insert is a braided, fine-meshed screen, which is produced from a wire with a diameter of about 0.5 mm. The screen as a whole has a diameter of about 6 mm and a mesh width of 2 mm. As a whole, the screen has a thickness of about 1.3 mm, which is in this instance only a representative configuration.

To secure the screen in its position, it has been common practice to provide the lower core with a corresponding recess in the edge region of the pouring channel. Into this recess, the screen has until now been inserted by hand. If the screen is to be inserted into the lower core, this manual insertion will have to occur after the first shooting station. If it is not desired to remove shot—lower—cores from the conveyor plate, an operator will have to insert the screen between the first and the second shooting station. To this end, it is necessary that at least the region between the first and the second shooting station be freely accessible. Apart from arrangements that are necessary in this instance to prevent occupational accidents, the manual insertion of the screen is not only difficult, but also constantly subject to errors. Moreover, the manual action as has until now been necessary, allows to reduce cycle times only to a limited or insufficient extent.

It is therefore the object of the present invention to describe an apparatus for inserting a part into a foundry core being completed to a core assembly, which apparatus facilitates fully automatic handling of the part being inserted and, thus, a fully automatic assembly of cores.

SUMMARY OF THE INVENTION

The above and other objects and advantages of the present invention are achieved by the provision of an apparatus for producing foundry core assemblies comprising a plurality of core shooting stations, and wherein at least one conveyor plate is transferred serially between the shooting stations and which is adapted to receive a foundry core at each shooting station to form a foundry core assembly. Means are provided for assembling a part onto a foundry core which is positioned on the conveyor plate at a location between two of the shooting stations, the assembling means comprising a magazine for storing a plurality of the parts, and a manipulator for receiving a part from the magazine and delivering the part to the foundry core.

In accordance with the invention, it has been recognized that the insertion of the solidification screen has to occur automatically or fully automatically in like manner as the remaining core shooting and core assembling operations. To this end, the screen or the part that is to be made available and inserted is kept in a magazine. A manipulator is used to receive the part from the magazine and to deliver same to the foundry core. Finally, a transfer device is provided, which serves to move the manipulator between the magazine or its removal station and the foundry core or the delivery station of the manipulator. In other words, the part being inserted is kept available in an associated unit and supplied to the production process between two core shooting stations. The action by an operator, except the exchange or the refilling of a magazine, is no longer necessary.

With respect to the magazine storing the parts, it will be of advantage, when same comprises a preferably vertically arranged container for the parts. Below the container, a lifting mechanism is arranged for moving into the container and for raising the parts to a delivery position, so that the parts are raised upward, right to the last part, through the container to the delivery position. In a further, advantageous manner, the lifting mechanism is constructed as a lifting spindle with a lifting plate for supporting or raising the parts, the lifting plate having preferably a smaller diameter than the parts.

To make sure that a part is in fact available in the delivery position, i.e., at the upper end or above the container, a sensor for detecting the presence of a part is advantageously provided in the delivery position. This sensor is used primarily for controlling the lifting mechanism, so as to activate the lifting spindle after removal of a part, and to raise a subjacent part to the delivery position. In a further, advantageous manner the sensor could be designed and constructed as a photodetector. Depending on the material of the parts, it would to possible to consider likewise the use of sensors operating by inductance, capacitance, or even by the eddy current principle.

In the case of circular-symmetrical parts, it will be highly advantageous, when the container is constructed as a tube having a circular cross section. This tube could again be surrounded at least in part by a holder. In this instance, the tube will have to be accessible for grasping and sliding same out of the holder. Since the lifting spindle enters together with the lifting plate from the bottom into the tube, same could have at its lower end an inner edge, which prevents the parts from falling out. Likewise, it would be possible to close the tube by a special end piece, which can be pushed into the tube by activating the lifting spindle or by the lifting plate. Finally, as regards the material used, it will be very advantageous, when the container is made of a recycled or recyclable plastic or cardboard. This will effectively prevent the accumulation of industrial waste.

As aforesaid, the manipulator serves on the one hand for receiving and on the other hand for delivering the parts. More specifically, the manipulator could comprise a special receiving device for taking over the part from the magazine and a lifting device for raising the part from the magazine and lowering the part onto the foundry core. Likewise, it would be possible to associate to the manipulator a further sensor for detecting the part received, so as to ensure before moving the manipulator that the receiving device holds in fact a part. This sensor could be constructed as a photodetector in the same way as the sensor associated to the delivery station of the magazine. Depending on the material of the parts being handled, it would likewise be possible to consider a sensor operating by induction, capacitance, or even by the eddy current principle.

Should the parts being handled be magnetic parts, the receiving device of the manipulator could comprise, besides a receiving plate for a positioned takeover of the parts, a holding magnet that is arranged preferably in the center. Likewise, it would be possible to provide other magnets which extend in one plane. In the case of two magnets, same could be arranged diametrically opposed to one another with respect to an axis of rotation of the receiving device. Naturally, depending on the part being raised, it would also be possible to provide other holding devices in the place of the holding magnet. Besides a mechanical gripper, it would also be possible to use a suction device.

The above-proposed holding magnet could be constructed as a permanent magnet or an electromagnet. In the case of using an electromagnet, the parts could be released plain and simply by deenergizing the magnet. Thus, for example, it would be possible to use an electromagnet which is supplied with direct current of a voltage that is rated so low that it is able to lift just one part and only a single part. Once this part is received or picked up, the full operating voltage will be applied, so that the part is safely held during the transfer.

In any case, it will furthermore be of advantage, when the holding magnet is located outside of, preferably above the plane of the receiving plate and is spaced apart therefrom such that upon contacting the parts or the upper part by the receiving plate, only a single part "adheres" thereto and can be raised. In particular, with the use of a permanent magnet, the spacing between the holding magnet and the part is dimensioned—by the distance from the receiving plate—in such a manner that one part barely adheres, whereas the adherence of a subjacent second part is precluded with certainty.

As regards the special configuration of the holding device, it will be of further advantage, when the receiving plate can be pressed, together with the holding magnet, against the parts resiliently while being biased by a spring force. This configuration allows to move the holding device by means of the lifting device of the manipulator, until it comes in full contact with the parts, thereby preventing the parts from being destroyed by the spring-back resilience of the holding device or the receiving plate. The holding magnet rebounds along with the receiving plate, so that the predetermined or adjusted spacing between the holding magnet and the part is thereby not reduced. Thus, the adherence of only one of the parts being picked up is likewise guaranteed in this respect.

In a very advantageous manner, the receiving plate is provided with engagement means for contacting the container or an overlying short feed tube in exact alignment therewith. These engagement means serve to quasi couple the receiving plate to the container or the feed tube, so that the part is received accurately positioned, in particular for its subsequent delivery to the foundry core. Thus, an adjustment is not needed when the now-received part is deposited.

In the case of using an electromagnet, the received and transferred part can be released by deenergizing the electromagnet, or the part can be dropped upon deenergizing the electromagnet. However, when a permanent magnet is used as holding magnet, it will be necessary to retract the holding magnet for its deactivation so far that it discontinues to exert a holding force on the part held until now. To this end, it would be possible in the concrete case to provide retraction means for removing the holding magnet from the receiving plate. These retraction means could again be constructed as a preferably pneumatically operating cylinder-piston arrangement, so that for depositing the part the holding magnet is retracted, i.e., removed from the part by means of the cylinder-piston arrangement.

As things now stand, it is common practice to shoot in one core shooting station often more, preferably two sand molds or foundry cores, and to deposit same on conveyor plates. Accordingly, it will be very advantageous to provide two spaced-apart containers, which are positioned, preferably in accordance with the spacing between the foundry cores. These two containers may be arranged linearly side by side, namely parallel to the actual production line of the foundry cores. Likewise, it would be possible to arrange several containers in the fashion of a revolving magazine.

The arrangement of the containers in the fashion of a revolving magazine would have the great advantage that numerous parts, possibly even different parts, could be made available. As previously indicated, if two side by side positioned foundry cores are each to receive a part, it would then be possible to arrange the containers of the magazine in pairs opposite to one another with respect to an axis of rotation, so that respectively two opposite magazines would have the same spacing between each other as the foundry cores positioned on the conveyor plate. This would facilitate a simultaneous, linear delivery of the parts without a further positioning. Thus, for example, a magazine with eight containers may be realized, with two containers each being diametrically opposed to one another.

As regards a particular configuration of the magazine, it will be advantageous, when the containers are displaceable by means of a so-called index table below a stationary bridge or within a housing, and when they can be positioned below a feed tube that is inserted into the bridge or housing at the upper end and extends toward the receiving device. It would then be possible to push or raise the parts—by means of the lifting plate—through openings in the bridge or through the feed tube. The feed tube itself would then form the delivery station, which is again monitored by the aforesaid sensor or photodetector.

Depending on the configuration of the magazine, the manipulator could also be provided, for simultaneously transferring, for example, two parts, with two of the above-described receiving devices. These receiving devices would then be arranged in accordance with the position of the pair of diametrically opposed containers. These two receiving devices could be rigidly interconnected via a bridge. In this arrangement, the lifting device serving to raise and lower the manipulator could mount the bridge, preferably in its center. If need be, it would be possible to provide a rotary connection, so that the receiving devices can be pivoted about a vertical axis. This would facilitate an adaptation to the exact position or angular position of the foundry cores being equipped with the parts.

Finally, within the scope of a special configuration of the transfer device, it will be of advantage, when same comprises a preferably linear guiding unit. It would be possible to joint the lifting mechanism of the manipulator—rigidly or movably—to this linear guiding unit. The linear guiding unit could again be provided with a linear cylinder without a piston rod, which is quite particularly suitable for linear movement of the manipulator.

In a very advantageous manner, the parts being inserted are screens, which serve as casting aids for the molten metal being poured. These screens are also named solidification screens, and they are inserted into a recess preferably formed in the lower foundry core of a core assembly. The following description relates exclusively to the insertion of these so-called solidification screens into the lower foundry core of a core assembly.

There exist various possibilities of improving and further developing in advantageous manner the teaching of the present invention. To this end, reference may be made to the following description of an embodiment of the invention with reference to the drawing. In conjunction with the description of the preferred embodiment of the invention with reference to the drawing, also generally preferred embodiments and further developments of the teaching will be described.

DETAILED DESCRIPTION OF THE PREFERRED EMBODIMENTS

Figure 1:
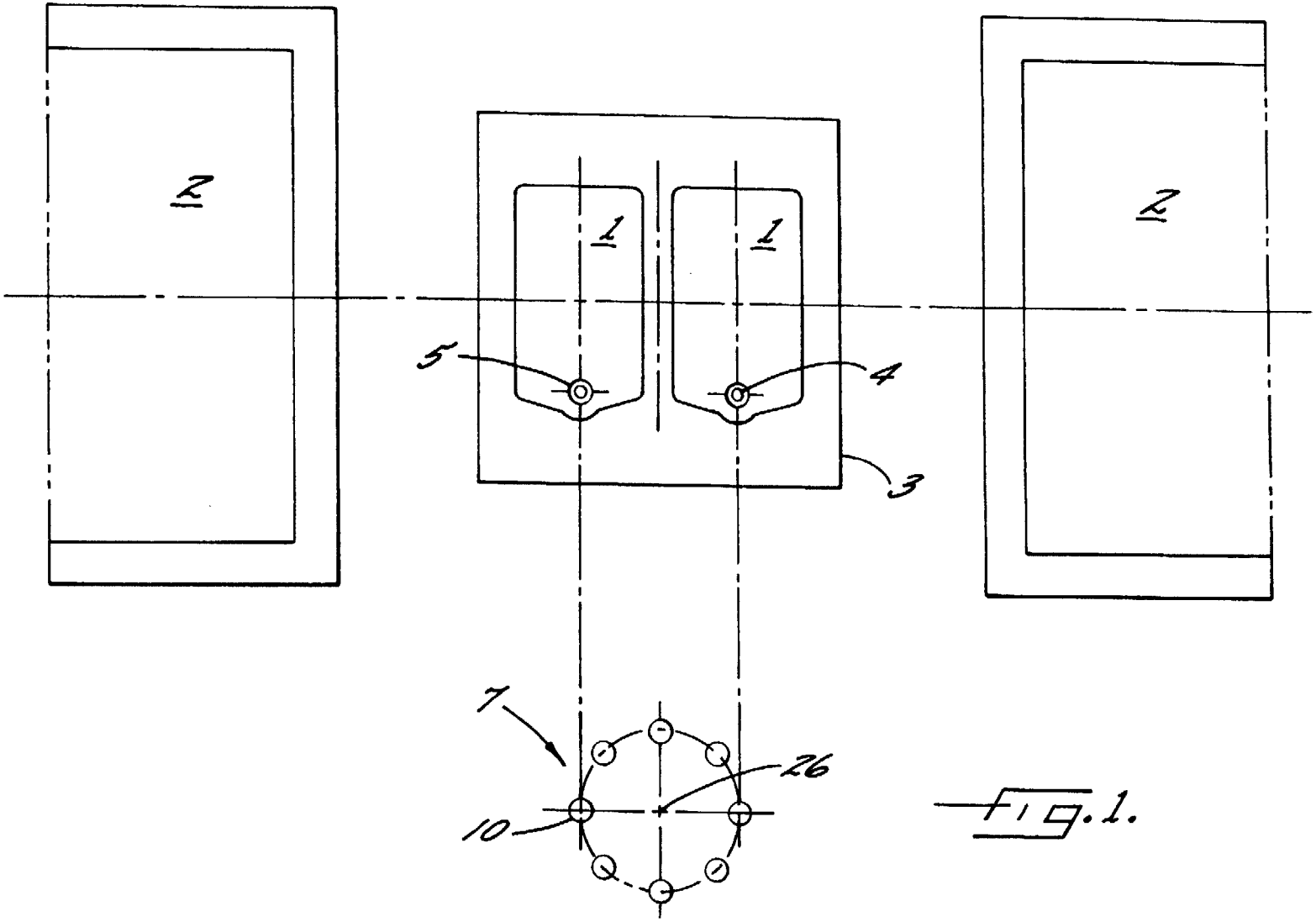
FIG.1 is a schematic view of an embodiment of an apparatus in accordance with the invention between two core shooting stations.

FIG. 1 is a schematic view of an embodiment of an apparatus in accordance with the invention for inserting a part into a foundry core 1 that is to be completed to a core assembly, namely between two core shooting stations or core shooting machines 2. The two foundry cores 1 are arranged on a conveyor plate 3, which may in this instance be the lower tool of the first core shooting station 2. The conveyor plate 3 carries at the same time two foundry cores 1, which were shot at the same time. The foundry cores 1 have an opening 4 for the molten metal that is poured later into the complete core assembly. Each lowest foundry core 1 is provided with a recess 5 for inserting a part or, in the present case, a screen 6. This recess 5 is only indicated in FIG. 1.

Figure 2:
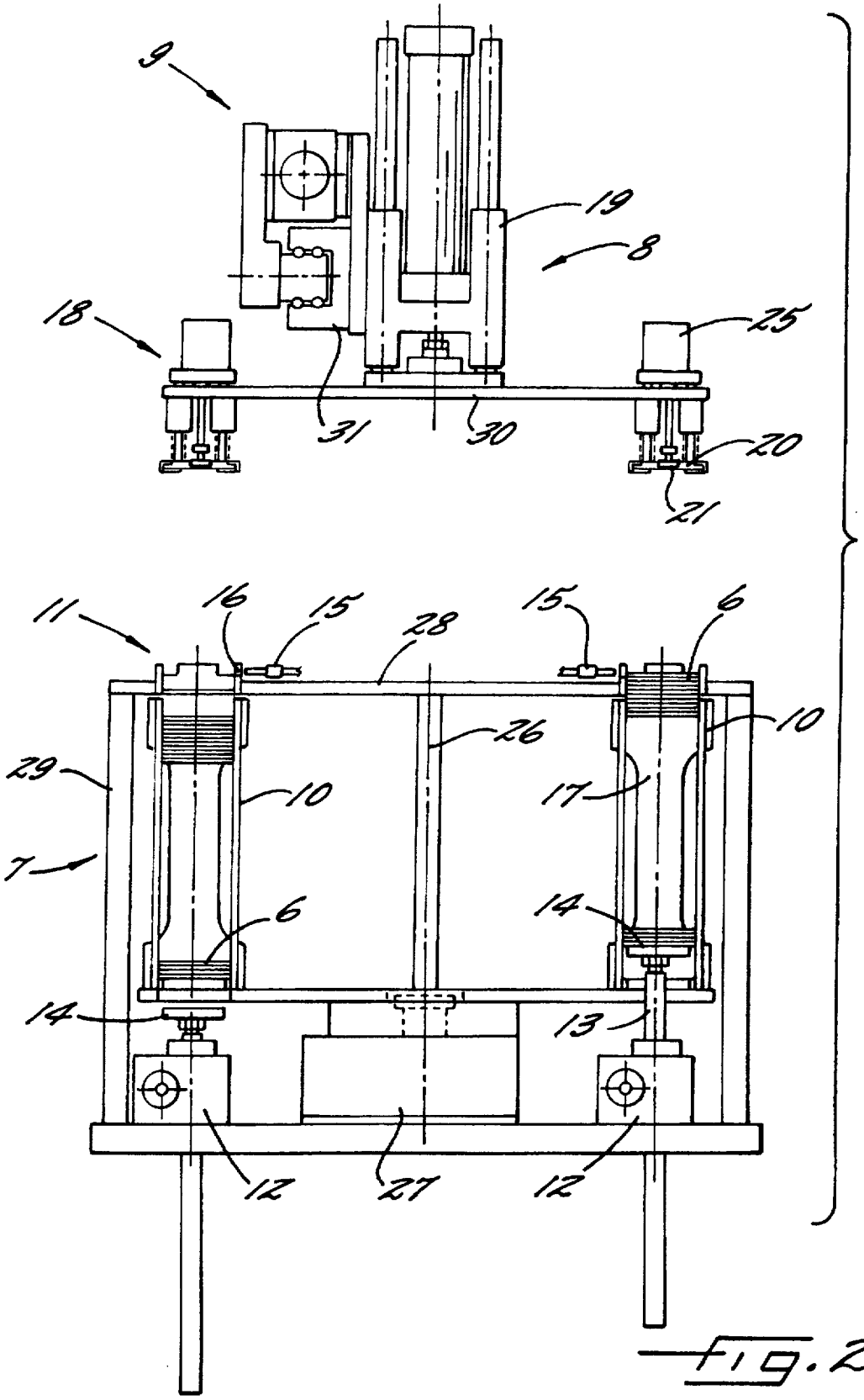
FIG. 2 is a schematic sectional front view showing in detail a concrete embodiment of an apparatus in accordance with the invention.
Figure 3:
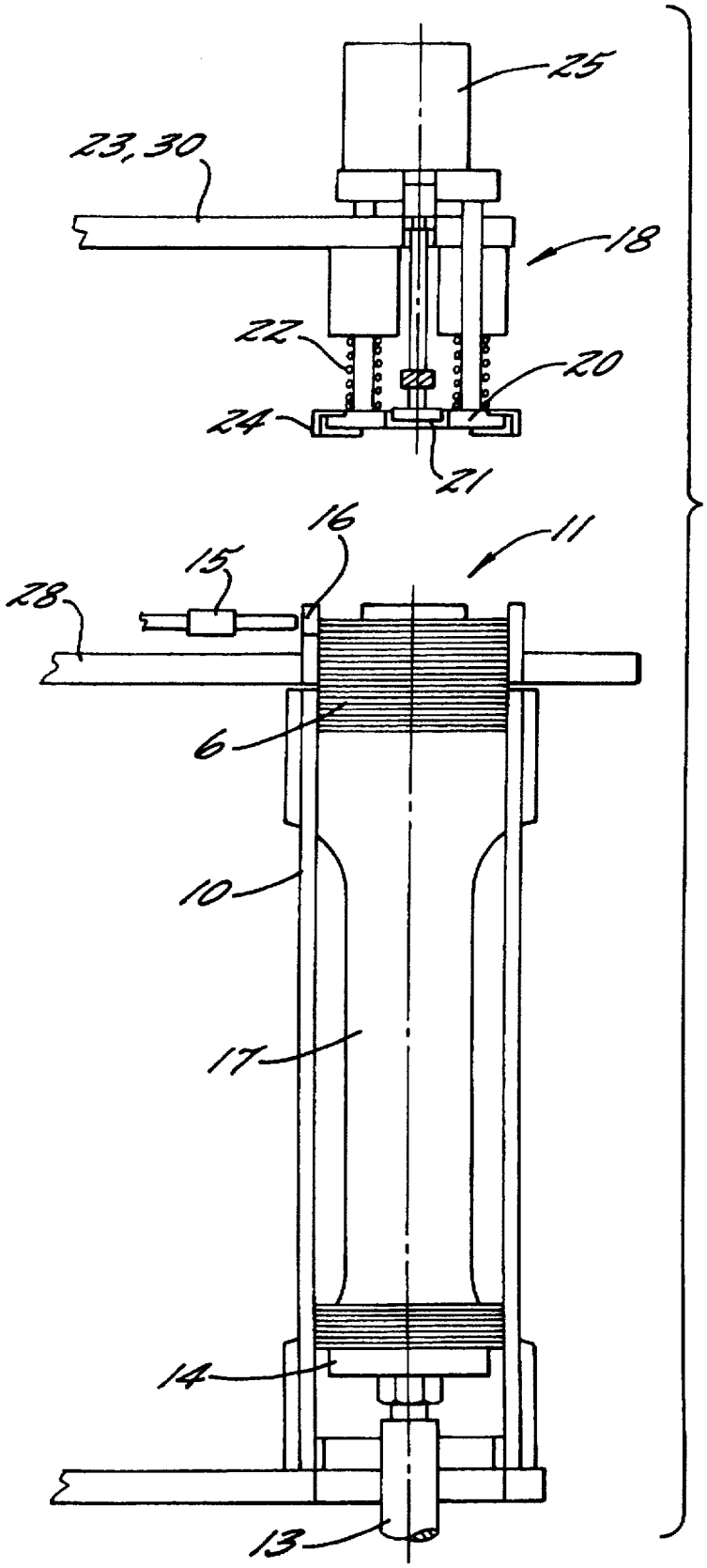
FIG. 3 is a schematic sectional view, partially enlarged, of the manipulator and a container of the magazine of the apparatus shown in FIG. 2.

As best seen in FIGS. 2 and 3, there are provided a magazine 7 for making available the screen 6, a manipulator 8 for receiving the screen 6 from magazine 7 and for delivering screen 6 to foundry core 1, and a transfer device 9 for moving manipulator 8 between magazine 7 and foundry cores 1.

As illustrated in FIGS. 2 and 3, the magazine 7 comprises a vertically arranged container 10 for accommodating screens 6 and a lifting mechanism 12 which can be entered from the bottom into container 10 for raising the screens 6 to a delivery position 11. The lifting mechanism 12 comprises again a lifting spindle 13 with a lifting plate 14 which supports or raises the screens 6.

In the delivery position 11, i.e., at the upper end of container 10 or above same, a sensor 15 is provided for detecting the presence of a screen 6. This sensor 15 is used to control the lifting mechanism 12. In the present case, the sensor 15 is constructed as a photodetector and detects from the side through an opening provided in a feed tube 16.

As shown in FIGS. 1–3, the container 10 is made tubular. As best seen in FIGS. 2 and 3, the container 10 is partially surrounded by a holder 17 or pushed into same. For its removal, the container or the tube 10 is easily accessible. In the present case, the container 10 is made of cardboard, so that in this respect environmentally harmful waste is avoided.

As shown in the detail view of FIG. 3, the manipulator 8 comprises a receiving device 18 for receiving the screen 6 from magazine 7 and a lifting mechanism 19 for raising the screen 6 from magazine 7 and lowering same onto foundry core 1. Likewise, the manipulator 8 could again be provided with a sensor not shown in the Figures for detecting a received screen 6. Advantageously, this sensor would be an inductive sensor. However, it is also possible to use in this instance sensors operating by capacitance, by the eddy current principle, or even optical sensors.

In the embodiment selected in the Figures, the screens 6 are made of a magnetic material. Accordingly, the receiving device 18 comprises a receiving plate 20 and a holding magnet 21 associated to the receiving plate 20 in the center thereof. In the illustrated embodiment, the holding magnet consists of two permanent magnets, which extend above the plane of receiving plate 20 and one behind the other and, thus, are not visible together in the Figure. The holding magnet 21 is spaced from the receiving plate 20 such that upon contacting respectively a highest screen 6 by receiving plate 20, only a single screen 6 can be raised.

As further shown in FIG. 3, the receiving plate 20 can be pushed together with holding magnet 21 in resilient manner, while being biased by the force of a spring, against the screens 6 in magazine 7. To this end, compressible springs 22 are provided, which are operative in the region of a guideway between receiving plate 20 and a support 23. As can also be noted from FIG. 3, the receiving plate 20 is provided with engagement means 24 for contacting the container 10 or the feed tube 16 arranged thereabove in exact alignment therewith. A further, complicated positioning of receiving plate 20 is thus not needed.

To be able to deposit again a received screen 6 with simple means, the receiving device 18 is provided with retraction means 25 for removing the holding magnet 21 from receiving plate 20. The retraction means are constructed as a pneumatically operating cylinder-piston arrangement.

In the particular embodiment shown in the Figures, the magazine 7 comprises a total of eight containers 10 which are arranged in the fashion of a revolving magazine about a common axis of rotation 26. In this arrangement, it is essential that the containers 10 be diametrically opposed. Thus, respectively two opposite containers 10 have the same spacing between each other as the positioned foundry cores 1. To this end, reference is made in particular to the illustration of FIG. 1.

As shown in FIG. 2, the containers 10 are displaceable by means of an index table 27 below a stationary bridge 28 or in a machine frame 29. The containers 10 can be positioned exactly below the feed tubes 16 which are inserted into bridge 28 and extend in direction toward the receiving device 18. This allows to push the screens 6 through openings in the bridge 28 or through the feed tubes 16 to delivery position 11. As aforesaid, the sensor 15 is associated to each feed tube 16.

To meet the requirement for a simultaneous transfer of two screens 6, the manipulator 8 comprises two receiving devices 18. These receiving devices 18 are arranged or spaced from one another in accordance with the position of containers 10 that are diametrically opposed in pairs. The receiving devices 18 are rigidly interconnected by means of a bridge 30, which is supported in its center by lifting mechanism 19.

As schematically indicated in FIG. 2, the transfer device 9 comprises a linear guiding unit 31, to which the lifting mechanism 19 of manipulator 8 is jointed. In the selected embodiment, the linear guiding unit 31 comprises a linear cylinder without a piston rod.

Finally, it should be specifically emphasized that the foregoing embodiment has been selected merely arbitrarily for describing only the claimed teaching, but without limiting same to the selected embodiment.

We claim:

1. An apparatus for producing foundry core assemblies comprising a plurality of core shooting stations, at least one conveyor plate which is adapted to be transferred serially between the shooting stations and receive a foundry core at each shooting station to form a foundry core assembly, and means for assembling a part onto said foundry core which is positioned on said one conveyor plate at a location between two of said shooting stations, said assembling means comprising a) a magazine for storing a plurality of said parts; and b) a manipulator for receiving a part from said magazine and delivering the part to the foundry core which is positioned on said one conveyor plate at said location.

2. The apparatus as defined in claim 1 wherein said magazine comprises at least one vertically arranged container for receiving a plurality of the parts therein in a vertical stack, and a lifting mechanism positioned to enter said one container from below and lift the stack of parts so that the uppermost part is lifted to a delivery position.

3. The apparatus as defined in claim 2 wherein said lifting mechanism comprises a vertically movable lifting rod having a lifting plate at the upper end thereof for engaging the stack of parts.

4. The apparatus as defined in claim 2 wherein said magazine further comprises a sensor positioned for detecting the presence of a part at said delivery position, and means controlled by said sensor for actuating said lifting mechanism.

5. The apparatus as defined in claim 1 wherein said manipulator comprises a receiving device for picking up a part from the magazine, and a transfer device for moving the receiving device between the magazine and the foundry core.

6. The apparatus as defined in claim 5 wherein the manipulator further comprises a sensor for detecting a part picked up by said receiving device.

7. The apparatus as defined in claim 5 wherein said parts are magnetic, and wherein the receiving device comprises a receiving plate and at least one holding magnet.

8. The apparatus as defined in claim 7 wherein the one holding magnet is located outside of a plane defined by said receiving plate and spaced therefrom such that upon contacting a part by the receiving plate, only a single part can be retained.

9. The apparatus as defined in claim 8 wherein the receiving plate is resiliently mounted so as to permit it to be pushed against a part in a resilient manner.

10. The apparatus as defined in claim 7 wherein said magnet is mounted to a retraction device which permits the magnet to be selectively removed from the receiving plate.

11. The apparatus as defined in claim 5 wherein the receiving plate mounts an engagement device for accurately positioning the received part on the receiving plate.

12. An apparatus for producing foundry core assemblies comprising a plurality of core shooting stations, with each station being configured for producing at least two side by side foundry cores on a conveyor plate which is adapted to be transferred serially between the shooting stations, and means for assembling a part onto each of the two side by side foundry cores which are positioned on the conveyor plate at a location between two of the shooting stations, said assembling means comprising a) at least two magazines, each for storing a plurality of said parts, and b) a manipulator for receiving a part from each of said magazines and delivering the parts to respective ones of the foundry cores which are positioned on said conveyor plate at said location.

13. The apparatus as defined in claim 12 wherein said two magazines are spaced apart along a line which parallels the spacing between said two foundry cores which are positioned on the conveyor plate at said location.

14. The apparatus as defined in claim 13 wherein said assembling means further comprises a revolving support mounted for rotation about a vertical axis, and wherein said at least two magazines comprise a plurality of magazines arranged in a concentric circle on said revolving support so that selected pairs of magazines may be aligned along said line.

15. The apparatus as defined in claim 14 wherein said plurality of magazines are arranged on said revolving support so that the selected pairs of magazines are spaced apart a distance substantially equal to the spacing of said two foundry cores which are positioned on the conveyor plate at said location.

16. The apparatus as defined in claim 14 wherein said revolving support comprises a stationary bridge, and an index table rotatably mounted to said bridge for rotation about said vertical axis, and wherein said plurality of magazines are mounted to said index table.

17. The apparatus as defined in claim 14 wherein each of said magazines comprises a vertically arranged container for receiving a plurality of the parts therein in a vertical stack.

18. The apparatus as defined in claim 17 wherein said assembling means further comprises a pair of lifting mechanisms positioned to enter respective ones of the containers from below and lift the stack of parts therein when the containers are spaced apart along said line.

19. The apparatus as defined in claim 16 wherein said bridge mounts a pair of feed tubes which are spaced apart along said line, and such that a selected pair of said magazine containers may be positioned below respective feed tubes and parts can be lifted from the selected pair of magazine containers by said pair of lifting mechanisms and such that the uppermost part is lifted to a delivery position located in the respective feed tube.

20. The apparatus as defined in claim 19 wherein a senior is associated with each of said feed tubes for detecting the presence of a part at the feed tube, and means controlled by said sensors for vertically moving the pair of lifting mechanisms.

21. The apparatus as defined in claim 18 wherein said manipulator comprises a pair of receiving devices which are spaced apart a distance corresponding to the spacing of the pair of magazines which are aligned along said line, and a transfer device for simultaneously moving the pair of receiving devices between such pair of magazines and the two side by side foundry cores on the conveyor plate at said location.

22. The apparatus as defined in claim 21 wherein the pair of receiving devices are rigidly interconnected via a bridge, and wherein the manipulator further comprises a lifting mechanism mounted to the bridge.

23. The apparatus as defined in claim 22 wherein the manipulator further comprises a linear guiding unit, to which the lifting mechanism of the manipulator is connected.

* * * * *

UNITED STATES PATENT AND TRADEMARK OFFICE

CERTIFICATE OF CORRECTION

PATENT NO. : 5,758,710

DATED : June 2, 1998

INVENTOR(S) : Landua et al.

It is certified that error appears in the above-identified patent and that said Letters Patent is hereby corrected as shown below:

Column 9, line 12, "senior" should be --sensor--.

Signed and Sealed this

Tenth Day of November 1998

*Attest:*

*Attesting Officer*

BRUCE LEHMAN

*Commissioner of Patents and Trademarks*